US011852425B2

(12) United States Patent
Zhang et al.

(10) Patent No.: US 11,852,425 B2
(45) Date of Patent: Dec. 26, 2023

(54) HEAT EXCHANGER AND HEAT EXCHANGE SYSTEM INCLUDING THE SAME

(71) Applicant: Carrier Corporation, Palm Beach Gardens, FL (US)

(72) Inventors: Wei Zhang, Shanghai (CN); Abbas A. Alahyari, Glastonbury, CT (US); Jack Leon Esformes, Jamesville, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 49 days.

(21) Appl. No.: 17/113,663

(22) Filed: Dec. 7, 2020

(65) Prior Publication Data

US 2021/0190444 A1 Jun. 24, 2021

(30) Foreign Application Priority Data

Dec. 24, 2019 (CN) ..... 201911346709.6

(51) Int. Cl.
*F28F 9/22* (2006.01)
*F28D 7/16* (2006.01)

(52) U.S. Cl.
CPC ..... *F28F 9/22* (2013.01); *F28D 7/1607* (2013.01); *F28F 2009/228* (2013.01)

(58) Field of Classification Search
CPC .. F28F 9/22; F28F 2009/228; F28F 2009/226; F28F 2009/224; F28D 7/1607
(Continued)

(56) References Cited

U.S. PATENT DOCUMENTS 2,482,988 A * 9/1949 Mccollum ..... F28D 7/16 126/116 R
3,692,140 A * 9/1972 Smith ..... B64F 1/26 181/213

(Continued)

FOREIGN PATENT DOCUMENTS

WO 2013049219 A1 4/2013

OTHER PUBLICATIONS

European Search Report for Application No. 20215167.6; dated Apr. 26, 2021; 7 Pages.

*Primary Examiner* — Jianying C Atkisson
*Assistant Examiner* — Raheena R Malik
(74) *Attorney, Agent, or Firm* — CANTOR COLBURN LLP

(57) ABSTRACT

The present disclosure relates to heat exchangers and heat exchange systems such heat exchangers. The heat exchangers include a shell having an inlet and an outlet and heat exchange tube bundles arranged therein. The shell includes a first region communicating with the inlet configured to accommodate the heat exchange tube bundles and a refrigerant input from the inlet. The refrigerant performs heat exchange with a fluid in the heat exchange tube bundles. A second region is arranged between the first region and the outlet and communicates with the first region and the outlet. A heating device is disposed in the second region. Embodiments may optimize spatial layout of the heat exchanger tube bundles, effectively improving the utilization of shell space of the heat exchanger the heat transfer efficiency of the heat exchanger at the same material cost, and enhance the overall performance, safety and reliability of the system.

19 Claims, 3 Drawing Sheets

(58) Field of Classification Search
USPC ..... 62/515
See application file for complete search history.

(56) References Cited

U.S. PATENT DOCUMENTS 3,795,273 A * 3/1974 Brigida ..... F22D 1/32 165/917
3,998,188 A * 12/1976 Priest ..... F24H 8/00 122/494
5,069,169 A * 12/1991 Maruko ..... F28D 7/12 165/142
5,454,429 A * 10/1995 Neurauter ..... F28F 13/06 138/38
5,477,846 A * 12/1995 Cameron ..... F24H 3/087 126/109
5,596,952 A * 1/1997 Lannes ..... F24D 3/082 122/15.1
5,775,268 A * 7/1998 Ferguson ..... F24H 1/36 122/18.31
6,047,106 A * 4/2000 Salyer ..... F28D 20/02 126/400
6,352,431 B1 * 3/2002 Gatley, Jr. ..... F27D 9/00 126/110 A
6,463,212 B1 * 10/2002 Salyer ..... F28D 20/02 126/400
6,493,507 B2 * 12/2002 Salyer ..... F24H 7/0433 126/400
6,612,267 B1 * 9/2003 West ..... F24H 1/52 122/13.3
6,910,349 B2 * 6/2005 Bodell, II ..... F25B 41/40 62/515
10,753,644 B2 * 8/2020 Niu ..... F24H 9/146
10,864,556 B2 * 12/2020 Guo ..... B08B 3/02
10,920,778 B2 * 2/2021 Kimura ..... F28D 7/16
2001/0028791 A1 * 10/2001 Salyer ..... F24H 7/0433 165/902
2011/0081134 A1 * 4/2011 Salyer ..... F28D 20/021 392/308
2011/0083459 A1 * 4/2011 Salyer ..... C09K 5/063 62/476
2011/0083827 A1 * 4/2011 Salyer ..... F28D 20/02 165/165
2016/0169229 A1 * 6/2016 Kimura ..... F28D 7/16 418/89
2017/0153049 A1 * 6/2017 Kondo ..... F28D 7/163
2019/0063801 A1 * 2/2019 Miyoshi ..... F25B 39/04
2021/0190444 A1 * 6/2021 Zhang ..... F28D 7/1607

* cited by examiner

HEAT EXCHANGER AND HEAT EXCHANGE SYSTEM INCLUDING THE SAME

CROSS REFERENCE TO RELATED APPLICATIONS

This application claims priority to Chinese Patent Application No. 201911346709.6, filed Dec. 24, 2019, the disclosure of which is incorporated herein by reference in its entirety.

FIELD OF THE INVENTION

The present disclosure relates to the technical field of heat exchange, and in particular to a heat exchanger and a heat exchange system including the heat exchanger.

BACKGROUND OF THE INVENTION

In the existing technologies, various types of heat exchange devices, apparatuses or systems have been provided, which have been widely used in many industrial fields, places, etc., and can bring great convenience. However, these existing heat exchange devices, apparatuses or systems still have some disadvantages and deficiencies in terms of structural configuration, heat exchange effect, working performance, manufacturing, installation and maintenance, etc., so there is a room for them to be further improved and optimized. For example, FIG. 1 shows a side view of the structure of an existing flooded evaporator. A shell of such a flooded evaporator is mostly cylindrical and has a large spatial volume, wherein heat exchange tube bundles are installed at the bottom of the shell. Mainly due to the limitation by liquid carryover (LCO), the heat exchange tube bundles are restricted in spatial arrangement, resulting in a large empty space formed at the top of the shell. Therefore, the shell space is not most effectively utilized, and the heat exchange tube bundles cannot be sufficiently immersed into a refrigerant entering the shell to achieve better heat transfer efficiency, which affects further improvements on the overall performance, safety, reliability and the like of the system.

SUMMARY OF THE INVENTION

In view of the above, the present disclosure provides a heat exchanger and a heat exchange system including the heat exchanger, which can solve or at least alleviate one or more of the above problems and other problems existing in the related art.

Firstly, according to an aspect of the present disclosure, a heat exchanger is provided, which includes a shell having an inlet and an outlet, and heat exchange tube bundles arranged in the shell, wherein the shell is provided therein with:

- a first region communicating with the inlet and configured to accommodate the heat exchange tube bundles and a refrigerant input from the inlet, the refrigerant performing heat exchange with a fluid in the heat exchange tube bundles; and
- a second region arranged between the first region and the outlet and communicating with the first region and the outlet, a heating device being disposed in the second region.

In the heat exchanger according to the present disclosure, optionally, the first region and the second region are arranged side by side in a length direction of the shell, and the inlet and the outlet are disposed under the first region and above the second region respectively.

In the heat exchanger according to the present disclosure, optionally, a ratio of a height of the heat exchange tube bundles to an internal height of the shell is not smaller than 0.5, and/or a liquid height of the refrigerant in the first region is not smaller than a height of the heat exchange tube bundles.

In the heat exchanger according to the present disclosure, optionally, the heating device is an electric heater or at least one row of heat exchange tubes, and the heat exchange tubes communicate with a fluid input end of the heat exchange tube bundles in the first region through a pipeline.

In the heat exchanger according to the present disclosure, optionally, the heating device is disposed at the bottom of the second region, and a ratio of the height of the heating device to a height of the second region is not larger than 0.5.

In the heat exchanger according to the present disclosure, optionally, the heat exchanger further includes:

- a flow guiding member arranged at least between the first region and the second region for guiding the refrigerant flowing out of the first region after the heat exchange to flow toward the second region and/or the outlet; and/or
- a liquid blocking member arranged at the outlet and configured to prevent a liquid-state refrigerant from flowing out of the shell.

In the heat exchanger according to the present disclosure, optionally, the flow guiding member is configured as a baffle having an arc shape, and/or the liquid blocking member is configured as a wire mesh having a structure of at least two layers.

In the heat exchanger according to the present disclosure, optionally, the heat exchanger further includes a control device connected to the heating device and configured to control an operation of the heating device.

In the heat exchanger according to the present disclosure, optionally, the heat exchanger further includes a detection device connected to the control device and configured to detect parameter information of the refrigerant in the first region and provide the parameter information to the control device for the control device to control the operation of the heating device.

Secondly, according to another aspect of the present disclosure, a heat exchange system is further provided, which includes the heat exchanger according to any one of the above technical solutions.

From the following detailed description in combination with the accompanying drawings, the principles, features, characteristics, advantages and the like of the various technical solutions according to the present disclosure will be clearly understood. For example, as compared with related art, the technical solutions of the present disclosure are easier to manufacture, install and maintain. By structurally optimizing and designing the shell space of the heat exchanger, the restrictions to spatial layout of the heat exchanger tube bundles in the conventional solutions are eliminated, so that the heat exchange tube bundles can be fully immersed into the refrigerant for heat exchange, which not only can effectively improve the utilization of shell space of the heat exchanger, but also can improve the heat transfer efficiency of the heat exchanger at the same material cost. In addition, by providing components such as the flow guiding member and the liquid blocking member, the overall performance, safety and reliability of the system can be further enhanced, and adverse effects on other components, devices, or apparatuses (such as a compressor) associated with the heat exchanger can be avoided.

BRIEF DESCRIPTION OF THE DRAWINGS

The technical solutions of the present disclosure will be further described in detail below with reference to the accompanying drawings and embodiments. However, these drawings are designed merely for the purpose of explanation, are only intended to conceptually illustrate the structural configuration herein, and are not required to be drawn to scale.

DETAILED DESCRIPTION OF THE EMBODIMENTS OF THE INVENTION

Figure 1:
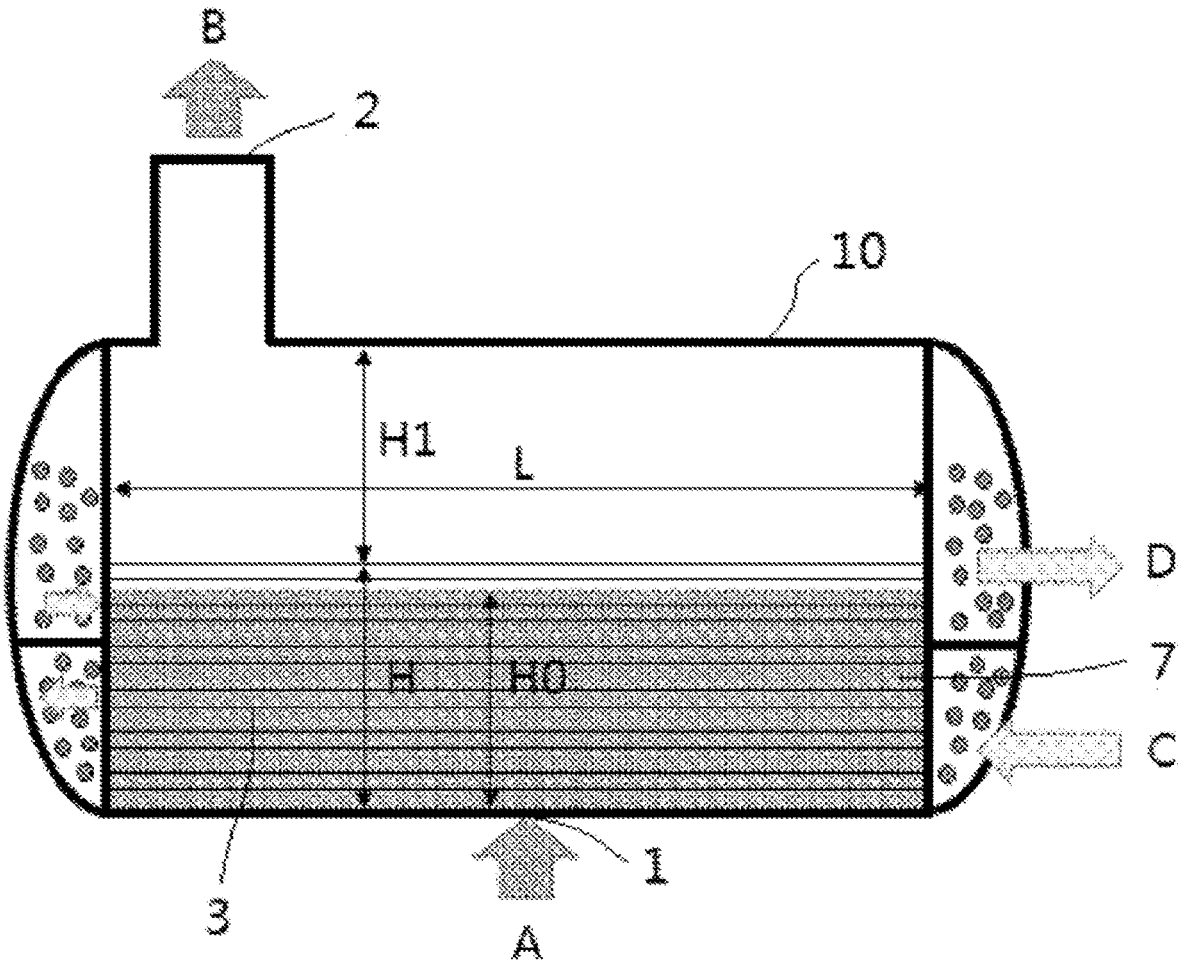
FIG. 1 Prior Art
FIG. 1 is a schematic side structural view of a flooded evaporator in the related art.

First, it is noted that the structural components, characteristics, and advantages of the heat exchanger and the heat exchange system including the heat exchanger of the present disclosure will be specifically described below by way of example. However, all the description is only for illustration, and does not limit the present disclosure in any way. Herein, the technical terms "first" and "second" are only used for the purpose of distinguishing the expressions, and are not intended to indicate their order and relative importance. The technical term "substantially" is intended to include non-substantive errors associated with the measurement of a specific amount (for example, it may include a range of ±8%, ±5%, or ±2% of a given value), and the technical terms "upper", "lower", "top", "bottom", "inner", "outer", "left", "right" and derivatives thereof should be related to the orientations in the drawings; unless explicitly indicated otherwise, the present disclosure can take a variety of alternative orientations.

In addition, for any single technical feature described or implied in the embodiments mentioned herein, the present disclosure still allows for any combination or deletion of these technical features (or equivalents thereof) to obtain more other embodiments of the present disclosure that may not be directly mentioned herein. In addition, in order to simplify the drawings, identical or similar parts and features may be marked in only one or more places in the same drawing.

Figure 2:
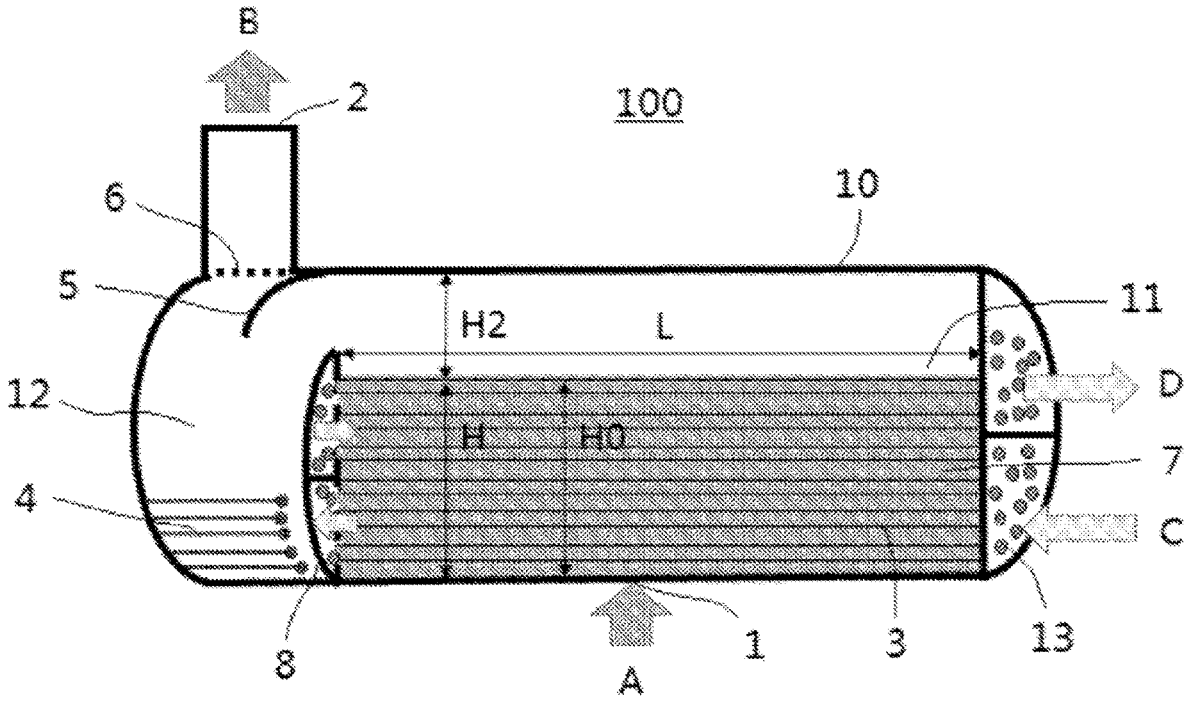
FIG. 2 is a schematic side structural view of an embodiment of a heat exchanger according to the present disclosure.

A general structure of an embodiment of a heat exchanger according to the present disclosure is schematically shown in FIG. 2, and an exemplary description will be given below through this embodiment so that obvious technical advantages of the present disclosure over existing heat exchangers such as shown in FIG. 1 can be clearly understood.

As shown in FIG. 2, the heat exchanger 100 has a shell 10. The shell 10 may be configured to have any suitable shape such as a cylinder, a rectangular parallelepiped and the like according to specific application requirements. The shell 10 is provided with an inlet 1 and an outlet 2, and two different regions are disposed in the interior of the shell 10, namely a first region 11 and a second region 12, wherein heat exchange tube bundles 3 are arranged in the first region 11, and a heating device 4 is arranged in the second region 12.

More specifically, a baffle 8 may be provided and installed inside the shell 10 by means of connection such as welding, so that the above mentioned two regions 11 and 12 are formed. Such a baffle 8 may also support the heat exchange tube bundles 3 arranged in the first region 11. In practical applications, the number, the spacing of arrangement, the size, the shape and structure, the materials used and the like of the above baffle 8 and the heat exchange tube bundles 3 may also each be selected and set as required.

In FIG. 2, arrows A and B are respectively used to schematically indicate that a refrigerant 7 (such as hydrofluoroolefin (HFO), hydrofluorocarbon (HFC), etc.) used for heat exchange enters the first region 11 of the shell 10 from the inlet 1, and finally leaves the shell 10 from the outlet 2 and enters other components, devices or apparatuses such as a compressor (not shown). At the same time, in FIG. 2, arrows C and D are also respectively used to schematically indicate that another fluid (such as water, glycol, saline, etc.) will flow through the heat exchange tube bundles 3 arranged in the first region 11. During the flow of the fluid, a heat exchange process will be completed between the fluid and the above-mentioned refrigerant 7. Generally speaking, the above-mentioned refrigerant 7 undergoes boiling heat transfer in the first region 11, and a part of the refrigerant 7 will be evaporated and then flow out from the first region 11 in a gaseous state (which may entrain a part of the refrigerant 7 in a gas-liquid mixed state). For example, it flows substantially toward the second region 12 in the example of FIG. 2.

In the shell 10, the second region 12 is arranged between the above-mentioned first region 11 and the outlet 2, and it is in fluid communication with both the first region 11 and the outlet 2. In this way, after leaving the first region 11, the above-mentioned gaseous refrigerant 7 will flow through the second region 12 and then flow out of the heat exchanger 100 from the outlet 2.

As shown in FIG. 2, a heating device 4 for providing thermal energy is disposed in the second region 12. For example, the heating device 4 may be installed at the bottom of the second region 12 or at any other suitable position so that the refrigerant 7 flowing out of the first region 1 can be heated and it can be more fully and thoroughly vaporized, and undesired damages to components, devices or apparatuses associated with the heat exchanger 100 such as the compressor caused by the possible entrained liquid are avoided.

By way of example, while the refrigerant 7 input from the inlet 1 can be accommodated in the first region 11 formed by, for example, installing a baffle 8, during the heat exchange process between the refrigerant 7 and the fluid in the heat exchange tube bundles 3, there may be some refrigerant liquid splashing from the first region 11 into the second region 12 or entrained in the refrigerant vapor flowing out of the first region 11, that is, the refrigerant 7 entering the second region 12 from the first region 11 is mostly gaseous, but a part of the refrigerant 7 may be in a liquid state or a gas-liquid mixed state. The heating device 4 arranged in the second region 12 enables the refrigerant 7 in a liquid state or gas-liquid mixed state to be heated to enter a gaseous state as well after the temperature rise, thereby effectively preventing associated components, devices or apparatuses such as the compressor from being easily damaged by the liquid flowing out of the outlet 2.

Those skilled in the art can easily understand that the above-mentioned heating device 4 may be implemented in many forms, such as an electric heating device, a hot-fluid (such as heat transfer oil, vapor, etc.) heating device, increased and enhanced heat exchange tube bundles, and the like. As an optional situation, the heating device 4 may in some applications be arranged such that a ratio of a height of the heating device 4 to a height of the second region 12 is not larger than 0.5, so as to ensure that a more sufficient empty space is provided to accommodate the refrigerant 7 (which may be in a gaseous state, a liquid state, or a gas-liquid mixed state) flowing out of the first region 11 and that the refrigerant 7 can be sufficiently heated and evaporated during the stay. For example, it may be considered that the above height ratio is in a value range of 0.3-0.5. Of course, the use of other ratios such as 0.1, 0.13, 0.2, 0.25 and the like is also possible and allowed in some application situations.

Since the above-mentioned second region 12 is disposed in the shell 10 and the heating device 4 is disposed in the second region 12, the heat exchanger according to the present disclosure can overcome the restrictions to spatial layout of the heat exchanger tube bundles in the conventional solutions such as shown in FIG. 1, and realize technical advantages that are significantly superior to existing heat exchangers.

For example, reference is made to FIG. 2, in which a height of the heat exchange tube bundles 3 arranged in the first region 11 and a height of an empty space above the heat exchange tube bundles 3 are indicated by reference signs H and H2 respectively. In some embodiments according to the present disclosure, the heat exchange tube bundles 3 may be arranged such that the ratio of the height H thereof to the internal height of the shell 10 (i.e., H+H2) is not smaller than 0.5, which will be significantly different from the conventional arrangement shown in FIG. 1, and the restrictions to the layout of the heat exchanger tube bundles in such heat exchangers in the related art are overcome.

Reference is made to FIG. 1 for comparison. In the existing heat exchanger shown in this figure, due to the limitation by the liquid carryover (LCO), the arrangement height H of the heat exchange tube bundles 3 is generally not larger than the height H1 of the empty space above the heat exchange tube bundle s3, that is, H will not exceed 0.6 times the height of the shell 10 (i.e. H+H1), i.e., H/(H+H1)<0.6, so as to provide sufficient head space to avoid the above-mentioned LCO. Moreover, in actual operations, the heat exchange tube bundles 3 are usually not completely immersed into the refrigerant 7 (i.e., H0<H) to further avoid the occurrence of the above-mentioned LCO; that is, the height H0 of the refrigerant 7 should be smaller than the height H of the heat exchange tube bundles 3. These arrangements not only fail to make full use of the internal space of the shell of the heat exchanger, resulting in a great waste of resources, but also affect and limit the improvement of heat exchange efficiency.

For example, in the embodiment of the heat exchanger shown in FIG. 2, in a case that the heat exchange tube bundles 3 having the same length L and the same height H as those in FIG. 1 are used, the height of the empty space in the shell 10 of the heat exchanger 100 can be significantly reduced (that is, H2<H1; for example, H2 may be only a half of H1, or less). As such, a space utilization can be greatly improved, that is, more heat exchange tube bundles 3 can be arranged for heat exchange, given the same shell volume space. At the same time, the present disclosure also allows the refrigerant 7 accommodated in the first region 11 to be completely immersed into the heat exchange tube bundles 3; that is, the height of the refrigerant 7 in the first region 11 may not be smaller than the height H of the heat exchange tube bundles 3, so that a more sufficient heat exchange effect can be obtained, which is completely unimaginable with the existing technology which will actually have to actively avoid the above situations. According to actual test data, in case of the same material cost as that of the conventional heat exchanger, applying the heat exchanger of the present disclosure can significantly improve the heat transfer efficiency of the heat exchanger.

Continued reference is made to FIG. 2. In this embodiment, both a flow guiding member 5 and a liquid blocking member 6 are further shown. They are provided as optional components in the shell 10 of the heat exchanger 100, that is, in some other embodiments according to the present disclosure, one of them may be omitted, or both of them may be omitted at the same time.

As for the flow guiding member 5, it may be arranged between the first region 11 and the second region 12 so as to guide the refrigerant 7 flowing out of the first region 11 to flow toward the second region 12 and/or the outlet 2. In FIG. 2, it is only exemplarily shown that the flow guiding member 5 may be optionally configured as a baffle having an arc shape, and the use of such an arc-shaped baffle can promote the refrigerant 7 to flow from the first region 11 to the second region 12 via a substantially 90°-turn flow path, and then flow from the second region 12 toward the outlet 2 via a substantially 180°-turn flow path (or the range of flow direction change may be extended to any other angle between 0°-180°), thereby forming a very favorable heating-evaporation path, and promoting the liquid-state part of the refrigerant 7 to be more fully evaporated and vaporized.

However, it should be understood that in some applications, it is also within the scope of the present disclosure to set the flow guiding member 5 to have any other structural form such as an inclined straight plate, a F-shaped baffle, a folding plate and the like that can achieve the purpose of guiding the flow, so as to meet a variety of different practical needs. In addition, it should be noted that in some application scenarios, the flow guiding member 5 may also be arranged at any other suitable position, such as above the first region 11 and near the outlet 2 so that the flow of the refrigerant 7 inside the shell 10 can be guided as desired.

As for the liquid blocking member 6, it may be arranged at the outlet 2 of the shell 10 so as to prevent the liquid-state refrigerant 7 from flowing out of the shell 10, thereby preventing it from entering components, devices or apparatuses associated with the heat exchanger 100 such as the compressor and having an adverse effects on them. As an example, the above-mentioned liquid blocking member 6 may be implemented by using multiple layers of wire mesh. For example, the liquid blocking member 6 is formed by using two or more layers of metal wire mesh to block the refrigerant liquid from flowing out of the heat exchanger 100. The blocked refrigerant liquid will then drip into the second region 12 and be further heated and evaporated.

In addition, in some applications, the heat exchanger 100 may be further configured with a control device (not shown). This type of control device may be implemented in many ways, for example by hardware components such as chips and processors, software, or a combination of software and hardware. The control device may be connected to the heating device 4 to control an operation of the heating device 4 according to the application requirements. For example, the heating device 4 may be turned on or off as needed, or the current operating power of the heating device 4 may be adjusted, or the heating device 4 may be regulated according to a preset cycle (such as distinguishing between working days and non-working days within a week) or a time period (such as working hours and non-working hours in a day).

As a further example, a detection device (not shown) such as a liquid level sensor, a temperature sensor and the like may also be disposed in the heat exchanger 100 to detect and acquire parameter information (such as liquid level, temperature, etc.) of the refrigerant 7 in the first region 11 and then provide the parameter information to the control device discussed above so that the control device can control the operation of the heating device 4 based on such parameter information. For example, if the refrigerant 7 in the first region 11 is found to be lower than a preset liquid level according to the liquid level information detected by the detection device, then the control device may be used to reduce the current operating power of the heating device 4, or temporarily turn off the heating device 4 for a period of time until it is determined that the heating device 4 needs to be turned on again according to the subsequently detected liquid level information.

In specific applications, one or more detection devices may be arranged at appropriate positions in the shell 10 as required. These detection devices may collect the same type of parameters or different types of parameters, that is, the present disclosure allows a combined use of various types of detection devices at the same time, such as liquid level sensors, temperature sensors and the like.

It should also be noted that although the first region 11 and the second region 12 are arranged side by side in a length direction of the shell 10 in the embodiment shown in FIG. 2, and the inlet 1 and the outlet 2 are disposed under the first region 11 and above the second region 12 respectively, the present disclosure allows for any possible adjustment and change to the above layouts in different application environments. For example, the inlet 1 may be arranged on a side of the first region 11; for another example, the outlet 2 may be arranged on a side of the second region 12; for further another example, the first region 11 shown in FIG. 2 is extended to be under the second region 12 so that the second region 12 is located above a part of the first region 11. This will facilitate the formation of a more compact structural layout, which is suitable for some sites with relatively limited installation space.

In addition, for the inlet 1, the outlet 2, the heating device 4, the flow guiding member 5, the liquid blocking member 6, etc., the present disclosure allows the number of each of them provided at the same time to be two or more, which may be flexibly designed and adjusted according to the specific application requirements. In addition, FIG. 2 only exemplarily shows that the heat exchange tube bundles 3 may be in a form of two channels (that is, the fluid is input and output according to arrows C and D respectively), but in some applications, more fluid delivery forms such as a single channel, three channels, four channels and the like may be used. Furthermore, bulkheads 13 disposed at the ends of some heat exchangers may have any feasible configuration (such as a horizontal or inclined arrangement, a semi-ellipsoidal or semi-spherical shape, etc.), and may be used to define a path in which the fluid enters and leaves the heat exchange tube bundles 3, which has been exemplarily illustrated in FIG. 2.

Figure 3:
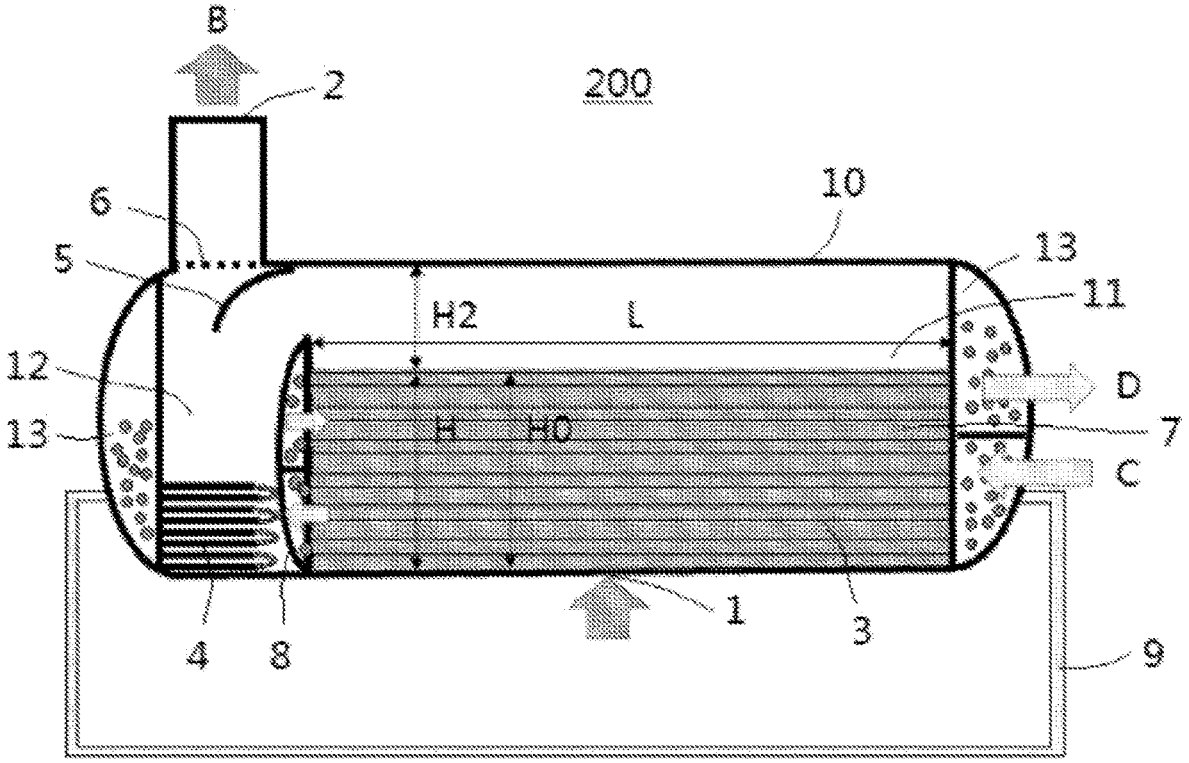
FIG. 3 is a schematic side structural view of another embodiment of a heat exchanger according to the present disclosure.

As another example, another embodiment of the heat exchanger according to the present disclosure is presented in FIG. 3. As for the heat exchanger 200, unless otherwise specified below, for contents identical or similar to those in the embodiment shown in FIG. 2 discussed above, since they have been described in great detail in the above, reference may be directly made to specific description in the foregoing corresponding parts in order to avoid repeated description.

As shown in FIG. 3, in the heat exchanger 200, one or more rows of heat exchange tubes may be arranged in the second region 12 to serve as the heating device 4, and the above-mentioned heat exchange tubes may communicate with a fluid input end of the heat exchange tube bundles 3 in the first region 11 through a pipeline 9. In this way, a bypass line can be formed by the pipeline 9 to transfer the fluid having a higher temperature at the fluid input end to the heat exchange tubes in the second region 12 that can be formed as enhanced heat exchange tube bundles so that thermal energy is provided to the second region 12 to realize the heating and temperature rise as described above, thereby avoiding adverse effects on components, devices, or apparatuses (such as the compressor) associated with the heat exchanger 200 caused by possible entrained liquid.

In the embodiment shown in FIG. 3, the above-mentioned heat exchange tubes are used as the heating device 4, and the operation of the heat exchange tubes may be controlled by providing the control device discussed above. For example, it may be implemented by controlling an on/off state, a flow/flow rate and the like of a flow path of the pipeline 9 by the control device as needed. After reading and understanding the present disclosure, those skilled in the art may adopt a number of means to specifically implement such a control, which will not be repeated herein. The bulkhead 13 at the left end of the heat exchanger 200 is also shown in FIG. 3. The bulkhead 13 may be used to store fluid supplied to the heat exchange tubes in the second region 12 through the pipeline 9 for heat exchange, so as to fully ensure that the heat exchange tubes have a good, lasting and reliable heating function.

According to another technical solution of the present disclosure, a heat exchange system is further provided, which may for example be provided with the above exemplified heat exchanger designed and provided by the present disclosure. For example, the heat exchanger may be used as a heat exchange device such as a flooded evaporator in the heat exchange system, so that the problems existing in the related art such as those mentioned above can be better solved, prominent technical advantages of the present disclosure discussed above which are significantly superior to the related art are obtained, and considerable economic benefits are achieved. It should be understood that the heat exchange system according to the present disclosure may for example include, but is not limited to, a heating, ventilation, and air conditioning (HVAC) system, a transportation refrigeration system, a freezing/refrigeration system, and the like.

The heat exchanger and the heat exchange system including the heat exchanger according to the present disclosure are explained in detail above by way of example only. These examples are only used to explain the principle of the present disclosure and embodiments thereof, and are not intended to limit the present disclosure. Those skilled in the art may also make various modifications and improvements without departing from the spirit and scope of the present disclosure. Therefore, all equivalent technical solutions shall fall within the scope of the present disclosure and be defined by the claims of the present disclosure.

What is claimed is:

1. A heat exchanger, comprising a shell having an inlet and an outlet, and heat exchange tube bundles arranged in the shell, wherein the shell comprises:

a first region communicating with the inlet and configured to accommodate the heat exchange tube bundles and a refrigerant input from the inlet, the refrigerant configured to perform a heat exchange with a fluid in the heat exchange tube bundles;

a second region arranged between the first region and the outlet, the second region configured to fluidly communicate with the first region and the outlet; and a heating device disposed in the second region configured to evaporate refrigerant not evaporated by the heat exchange tube bundles;

wherein the inlet is in fluid communication with the outlet such that refrigerant enters the first region from the inlet and refrigerant exits the second region through the outlet;

wherein the first region and the second region are arranged side by side in a length direction of the shell, and the inlet and the outlet are disposed under the first region and above the second region respectively, the first region and the second region not overlapping in a height direction of the shell.

2. The heat exchanger according to claim 1, wherein a ratio of a height of the heat exchange tube bundles to an internal height of the shell is not smaller than 0.5.

3. The heat exchanger according to claim 1, wherein the heating device is at least one of an electric heater or at least one row of heat exchange tubes, and the heat exchange tubes communicate with a fluid input end of the heat exchange tube bundles in the first region through a pipeline.

4. The heat exchanger according to claim 1, wherein the heating device is disposed at the bottom of the second region, and a ratio of the height of the heating device to a height of the second region is not larger than 0.5.

5. The heat exchanger according to claim 1, further comprising:

a flow guiding member arranged at least between the first region and the second region for guiding the refrigerant flowing out of the first region after the heat exchange to flow toward the second region.

6. The heat exchanger according to claim 5, wherein the flow guiding member is configured as a baffle having an arc shape.

7. The heat exchanger according to claim 1, further comprising a control device connected to the heating device and configured to control an operation of the heating device.

8. The heat exchanger according to claim 1, wherein a liquid height of the refrigerant in the first region is not smaller than a height of the heat exchange tube bundles.

9. The heat exchanger according to claim 1, further comprising:

a liquid blocking member arranged at the outlet and configured to prevent a liquid-state refrigerant from flowing out of the shell.

10. The heat exchanger according to claim 9, wherein the liquid blocking member is configured as a wire mesh having a structure of at least two layers.

11. The heat exchange system according to claim 1, wherein the heat exchange tube bundles of first region include first heat exchange tube bundles connected to a baffle and second heat exchange tube bundles connected to the baffle, wherein a fluid flows through the first heat exchange tube bundles in a first direction, through the baffle, and through the second heat exchange tube bundles in a second direction opposite the first direction.

12. A heat exchanger, comprising a shell having an inlet and an outlet, and heat exchange tube bundles arranged in the shell, wherein the shell comprises:

a first region communicating with the inlet and configured to accommodate the heat exchange tube bundles and a refrigerant input from the inlet, the refrigerant configured to perform a heat exchange with a fluid in the heat exchange tube bundles;

a second region arranged between the first region and the outlet, the second region configured to fluidly communicate with the first region and the outlet a heating device disposed in the second region configured to evaporate refrigerant not evaporated by the heat exchange tube bundles;

wherein the inlet is in fluid communication with the outlet such that refrigerant enters the first region from the inlet and refrigerant exits the second region through the outlet;

a control device connected to the heating device and configured to control an operation of the heating device;

a detection device connected to the control device and configured to detect parameter information of the refrigerant in the first region and provide the parameter information to the control device for the control device to control the operation of the heating device.

13. A heat exchange system, comprising:

a heat exchanger comprising a shell having an inlet and an outlet, and heat exchange tube bundles arranged in the shell, wherein the shell comprises:

a first region communicating with the inlet and configured to accommodate the heat exchange tube bundles and a refrigerant input from the inlet, the refrigerant configured to perform a heat exchange with a fluid in the heat exchange tube bundles;

a second region arranged between the first region and the outlet, the second region configured to fluidly communicate with the first region and the outlet; and a heating device disposed in the second region configured to evaporate refrigerant not evaporated by the heat exchange tube bundles;

wherein the heat exchange system is one of an HVAC system, a transportation refrigeration system, or a freezing/refrigeration system;

wherein the inlet is in fluid communication with the outlet such that refrigerant enters the first region from the inlet and refrigerant exits the second region through the outlet;

wherein the first region and the second region are arranged side by side in a length direction of the shell, and the inlet and the outlet are disposed under the first region and above the second region respectively, the first region and the second region not overlapping in a height direction of the shell.

14. The heat exchange system according to claim 13, wherein at least one of (i) a ratio of a height of the heat exchange tube bundles to an internal height of the shell is not smaller than 0.5 and (ii) a liquid height of the refrigerant in the first region is not smaller than a height of the heat exchange tube bundles.

15. The heat exchange system according to claim 13, wherein the heating device is at least one of an electric heater or at least one row of heat exchange tubes, and the heat exchange tubes communicate with a fluid input end of the heat exchange tube bundles in the first region through a pipeline.

16. The heat exchange system according to claim 13, wherein the heating device is disposed at the bottom of the second region, and a ratio of the height of the heating device to a height of the second region is not larger than 0.5.

17. The heat exchange system according to claim 13, further comprising:

a flow guiding member arranged at least between the first region and the second region for guiding the refrigerant flowing out of the first region after the heat exchange to flow toward the second region and/or the outlet.

18. The heat exchange system according to claim 13, further comprising:

liquid blocking member arranged at the outlet and configured to prevent a liquid-state refrigerant from flowing out of the shell.

19. The heat exchange system according to claim 13, further comprising a control device connected to the heating device and configured to control an operation of the heating device.

* * * * *